US011317218B2

(12) United States Patent
Zhao et al.

(10) Patent No.: US 11,317,218 B2
(45) Date of Patent: Apr. 26, 2022

(54) SOUND GENERATOR

(71) Applicant: Goertek Inc., Shandong (CN)

(72) Inventors: Guodong Zhao, Weifang (CN); Peijun Li, Weifang (CN); Yaqian Ji, Weifang (CN); Zhilei Han, Weifang (CN)

(73) Assignee: Goertek Inc., Shandong (CN)

( * ) Notice: Subject to any disclaimer, the term of this patent is extended or adjusted under 35 U.S.C. 154(b) by 94 days.

(21) Appl. No.: 16/975,772

(22) PCT Filed: Dec. 25, 2018

(86) PCT No.: PCT/CN2018/123301
§ 371 (c)(1),
(2) Date: Aug. 26, 2020

(87) PCT Pub. No.: WO2019/161704
PCT Pub. Date: Aug. 29, 2019

(65) Prior Publication Data

US 2020/0413201 A1 Dec. 31, 2020

(30) Foreign Application Priority Data

Feb. 26, 2018 (CN) ..... 201810163309.0

(51) Int. Cl.

| | |
|---|---|
| ***H04R 15/02*** | (2006.01) |
| ***H04R 9/02*** | (2006.01) |
| ***H04R 9/06*** | (2006.01) |
| ***H04R 9/18*** | (2006.01) |

(52) U.S. Cl.
CPC ..... *H04R 15/02* (2013.01); *H04R 9/025* (2013.01); *H04R 9/06* (2013.01); *H04R 9/18* (2013.01)

(58) Field of Classification Search
CPC ..... H04R 15/02; H04R 9/025; H04R 9/06; H04R 9/18; H04R 1/021; H04R 1/2803; H04R 2201/029; H04R 2400/11
See application file for complete search history.

(56) References Cited

U.S. PATENT DOCUMENTS

| | | | | |
|---|---|---|---|---|
| 2013/0148834 A1* | 6/2013 | Seo | H04R 1/2811 | 381/338 |
| 2015/0110336 A1* | 4/2015 | Song | H04R 1/02 | 381/412 |
| 2016/0192065 A1* | 6/2016 | Oosato | H04R 1/2826 | 381/378 |

FOREIGN PATENT DOCUMENTS

| | | |
|---|---|---|
| CN | 202759586 U | 2/2013 |
| CN | 205596332 U | 9/2016 |
| CN | 106454654 A | 2/2017 |

* cited by examiner

*Primary Examiner* — Tuan D Nguyen
(74) *Attorney, Agent, or Firm* — Baker Botts, LLP

(57) ABSTRACT

A sound generator comprises a shell, a vibration system and a magnetic circuit system, wherein the shell sequentially accommodates and fixes the vibration system and the magnetic circuit system from top to bottom; the magnetic circuit system comprises a magnetic conductive yoke, and a central magnetic circuit portion and a side magnetic circuit portion that are mounted on an upper surface of the magnetic conductive yoke; a magnetic gap is formed between the central magnetic circuit portion and the side magnetic circuit portion; and at least one of the central magnetic circuit portion and the side magnetic circuit portion is provided with a permanent magnet; the magnetic circuit system is provided with a rear sound hole; a rear cavity in communication with the rear sound hole is provided directly below the magnetic circuit system.

15 Claims, 6 Drawing Sheets

SOUND GENERATOR

CROSS-REFERENCE TO RELATED APPLICATIONS

This application is a National Stage of International Application No. PCT/CN2018/123301, filed on Dec. 25, 2018, which claims priority to Chinese Patent Application No. 201810163309.0, filed on Feb. 26, 2018, both of which are hereby incorporated by reference in their entireties.

TECHNICAL FIELD

The present invention relates to the technical field of sound generating device.

BACKGROUND

A sound generating device is an important component among electronic products and is used to convert electrical signals into acoustic signals. The electronic products have a development trend of getting thinner and thinner and tend to have more and more components contained therein in order to realize more functions, as such, space reserved therein for the sound generating device is bound to become smaller and smaller. In addition, more and more attention has been drawn to users' music experience from electronic products, and the sound generating device is required to have better sound quality.

In order to improve performance on music experience, prior art sound generating devices have a sound generator installed in a box with a certain volume. The sound generator includes a shell, as well as a magnetic circuit system and a vibration system accommodated and fixed in the shell. A rear cavity is formed between the sound generator and the box. The larger the rear cavity, the lower the low-frequency resonance frequency of the product, thereby the low-frequency performance of the product is improved. The sound generating device in the prior art typically has a structure with an accommodating cavity for accommodating a sound generator in the box, and a rear cavity on a side of the sound generator. Although forming the rear cavity on the side of the sound generator can realize the largest possible rear cavity volume, but at the same time, it also leads to a larger space occupation by the entire sound generating device in a horizontal direction, which is not conducive to the miniaturization of the product.

Furthermore, the sound generating device of the prior art is irregular in the shape of the rear cavity, and the airflow from the sound generator into the rear cavity is not stable enough, which is easy to cause problems such as polarization and distortion, resulting in an unsatisfactory acoustic effect.

If the volume of the sound generating device of the existing structure is reduced, the volume of the rear cavity of the sound generating device is bound to be reduced. Therefore, it is necessary to provide a novel structured sound generating device with a small volume while maintaining good performance to meet the development needs of electronic products.

SUMMARY

The embodiment of the invention provides a sound generator, which can meet the requirements of small volume while having good performance.

The invention further provides a sound generator, comprising a shell, a vibration system and a magnetic circuit system; wherein the shell sequentially accommodates and fixes the vibration system and the magnetic circuit system from top to bottom; the magnetic circuit system comprises a magnetic conductive yoke, and a central magnetic circuit portion and a side magnetic circuit portion that are mounted on an upper surface of the magnetic conductive yoke; a magnetic gap is formed between the central magnetic circuit portion and the side magnetic circuit portion; and at least one of the central magnetic circuit portion and the side magnetic circuit portion is provided with a permanent magnet; the magnetic circuit system is provided with a rear sound hole; a rear cavity in communication with the rear sound hole is provided directly below the magnetic circuit system; the shell further comprises a lower cover plate located at a bottom of the sound generator, the lower cover plate is configured to close the rear cavity; at least one support foot extending toward the lower cover plate is provided on the magnetic conductive yoke.

Optionally, the magnetic conductive yoke is rectangular, and a corner of the magnetic conductive yoke is provided with a first rear sound hole in communication with the magnetic gap and the rear cavity; the rear sound hole comprises the first rear sound hole.

Optionally, the central magnetic circuit portion comprises a central magnet and a central magnetic conductive plate provided on a top surface of the central magnet; at the central magnetic circuit portion, the magnetic circuit system is provided with a through hole that sequentially penetrates the magnetic conductive yoke and the central magnet as a part of the rear cavity, and a second rear sound hole in communication with the through hole is provided on the central magnetic conductive plate; the rear sound hole comprises the second rear sound hole.

Optionally, the through hole is composed of a central hole of the magnetic conductive yoke and a central hole of the central magnet, and the support foot is provided at a peripheral position of the central hole of the magnetic conductive yoke.

Optionally, the support foot is formed by stamping a material located at the central hole of the magnetic conductive yoke before the magnetic conductive yoke is holed.

Optionally, there is a gap between the support foot and the lower cover plate.

Optionally, the lower cover plate is made of metal.

Optionally, the shell comprises a straight cylinder-shaped shell body portion with openings at two ends, and the shell body portion accommodates and fixes the vibration system and the magnetic circuit system; the vibration system comprises a diaphragm and a voice coil fixed below the diaphragm, the diaphragm being fixed on an end surface of a first end opening of the shell body portion; the voice coil is suspended in the magnetic gap; the shell body portion comprises a first portion corresponding to the vibration system and the magnetic circuit system, and a second portion integrally extending downward from the first portion beyond a bottom surface of the magnetic circuit system; the lower cover plate is mounted at a second end opening of the shell body portion; and a rear cavity is formed between the second portion of the shell body portion, the bottom surface of the magnetic circuit system and the lower cover plate.

Optionally, an outer side of the magnetic circuit system is disposed in close contact with an inner wall of the shell body portion.

Optionally, the shell is of a rectangular structure.

Optionally, the lower cover plate is of a flat plate shape; or, the lower cover plate is of a bowl-shaped structure provided with a bottom wall and a side wall.

Optionally, the lower cover plate is made of a metal; an inner side of an end surface of the second end opening of the shell body portion is provided with a recessed second stepped end surface, the second stepped end surface is provided with a top surface and a side surface for mounting the lower cover plate; the lower cover plate is of a flat plate shape, an edge of the lower cover plate is provided with a recessed portion recessed toward the rear cavity, the recessed portion abuts on the top surface of the second stepped end surface, a first glue holding groove is formed between the recessed portion and the side surface of the second stepped end surface, and the first glue holding groove is coated with glue to fix the lower cover plate on the shell body portion; or, the lower cover plate is of a bowl-shaped structure provided with a bottom wall and a side wall, an end of the side wall of the lower cover plate is bent outward to provide a mounting edge, the mounting edge abuts on the top surface of the second stepped end surface, a second glue holding groove is formed between the mounting edge and the side surface of the second stepped end surface, and the second glue holding groove is coated with glue to fix the lower cover plate on the shell body portion; or a plastic edge is injection-molded on a periphery of the lower cover plate, and the plastic edge is ultrasonically welded to the second end opening of the shell body portion.

Optionally, the rear sound hole is provided with a breathable spacer, and the rear cavity is filled with a sound absorbing material.

In the technical solution provided in the embodiment of the invention, the shell sequentially accommodates and fixes the vibration system and the magnetic circuit system from top to bottom, and the rear cavity directly below the magnetic circuit system is closed by the lower cover plate of the shell. Compared with the prior art, the invention directly forms a sufficiently large rear cavity space from the lower end portion of the sound generator and the space directly below the magnetic circuit system. Firstly, there is no need to additionally configure the box structure forming the rear cavity, thus it will not increase the occupied space in the horizontal direction, and the peripheral area of the shell of the sound generator determines the size of the space occupied by the entire sound generating device in the electronic product, which helps to achieve miniaturization of the product, and on the basis of miniaturization, it can take into account both the volume of the magnetic circuit system and the volume of the rear cavity, thereby ensuring acoustic performance. Secondly, a rear cavity is arranged directly below the magnetic circuit system, and the rear cavity has a regular shape and is close to the rear acoustic hole. Compared with the prior art, the same large rear cavity volume can achieve a better acoustic effect. In addition, the support foot extending toward the lower cover plate on the magnetic conductive yoke can prevent the lower cover plate from being deformed under excessive pressure.

Other features and advantages of the invention will become clear from the following detailed description of exemplary embodiments of the invention with reference to the drawings.

BRIEF DESCRIPTION OF THE DRAWINGS

The drawings that form a part of the description describe embodiments of the invention, and together with the description serve to explain the principles of the invention.

DETAILED DESCRIPTION

Figure 1:
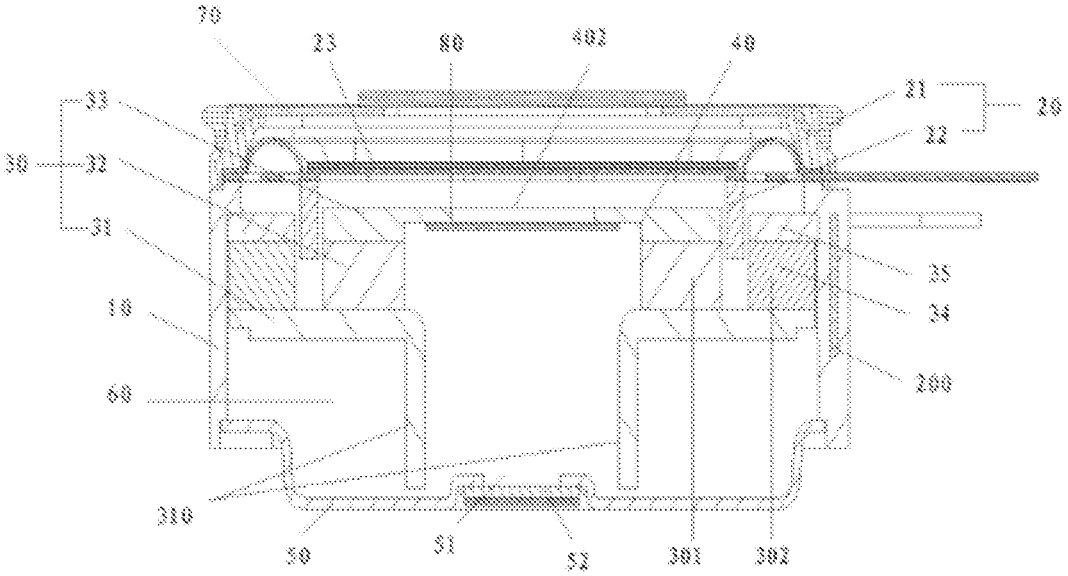
FIG. 1 is a schematic cross-sectional view of a sound generator provided by an embodiment of the invention.

Various exemplary embodiments of the invention will now be described in detail with reference to the drawings. It should be noted that: unless specifically stated otherwise, the relative arrangement of components and steps, numerical expressions, and numerical values set forth in these embodiments do not limit the scope of the invention. The following description of at least one exemplary embodiment is actually merely illustrative, and in no way serves as any limitation on the invention and its application or use.

Techniques and devices known to those of ordinary skill in the related art may not be discussed in detail, but where appropriate, the techniques and devices should be considered as part of the description. In all examples shown and discussed herein, any specific values should be interpreted as exemplary only and not as limitations. Therefore, other examples of the exemplary embodiment may have different values. It should be noted that: Similar reference numerals and letters indicate similar items in the following drawings. Therefore, once an item is defined in one drawing, there is no need to discuss it further in subsequent drawings.

FIG. 1 is a schematic cross-sectional view of a sound generator provided by an embodiment of the invention. As shown in FIG. 1, the sound generator includes a shell 10, a vibration system 20 and a magnetic circuit system 30; wherein, the shell 10 sequentially accommodates and fixes the vibration system 20 and the magnetic circuit system 30 from top to bottom; the magnetic circuit system 30 comprises a magnetic conductive yoke 31, and a central magnetic circuit portion 301 and a side magnetic circuit portion 302 that are mounted on an upper surface of the magnetic conductive yoke 31; a magnetic gap is formed between the central magnetic circuit portion 301 and the side magnetic circuit portion 302; and at least one of the central magnetic circuit portion 301 and the side magnetic circuit portion 302 is provided with a permanent magnet; the magnetic circuit system 30 is provided with a rear sound hole 40; a rear cavity 60 in communication with the rear sound hole 40 is provided directly below the magnetic circuit system 30; the shell 10 further comprises a lower cover plate 50 located at a bottom of the sound generator, the lower cover plate 50 is configured to close the rear cavity 60; at least one support foot 310 extending toward the lower cover plate 50 is provided on the magnetic conductive yoke 31.

In the technical solution provided in the embodiment of the invention, the shell sequentially accommodates and fixes the vibration system and the magnetic circuit system from top to bottom, and the rear cavity directly below the magnetic circuit system is closed by the lower cover plate of the shell. Compared with the prior art, the invention directly forms a sufficiently large rear cavity space from the lower end portion of the sound generator and the space directly below the magnetic circuit system. Firstly, there is no need to additionally configure the box structure forming the rear cavity, thus it will not increase the occupied space in the horizontal direction, and the peripheral area of the shell of the sound generator determines the size of the space occupied by the entire sound generating device in the electronic product, which helps to achieve miniaturization of the product, and on the basis of miniaturization, it can take into account both the volume of the magnetic circuit system and the volume of the rear cavity, thereby ensuring acoustic performance. Secondly, a rear cavity is arranged directly below the magnetic circuit system, and the rear cavity has a regular shape and is close to the rear acoustic hole. Compared with the prior art, the same large rear cavity volume can achieve a better acoustic effect. In addition, the support foot extending toward the lower cover plate on the magnetic conductive yoke can prevent the lower cover plate from being deformed under excessive pressure.

It should be noted that when the sound generator is assembled with the electronic device terminal, a certain pressure is applied to the lower cover plate of the sound generator, so that the sound generator and the electronic device terminal (such as the mobile phone end) are sealed. In the technical solution provided by the present invention, the support foot extending in the direction of the magnetic conductive yoke towards the lower cover plate limits the deformation of the lower cover plate to a certain extent, and prevent the sound generator from being deformed seriously from pressure and affecting the normal use of the sound generator.

Further, as shown in FIG. 1, the shell 10 includes a side wall, and a metal sheet 200 for shielding magnetic leakage is provided on the side wall of the shell 10 to avoid the influence of the magnetic leakage of the magnetic circuit system on the external circuit.

During the specific implementation, one of the following methods can be used to set the metal sheet 200:

Method One: as shown in FIG. 1, the metal sheet 200 is an individual component and the metal sheet 200 is fixed on the side wall of the shell 10 by injection molding.

Figure 9:
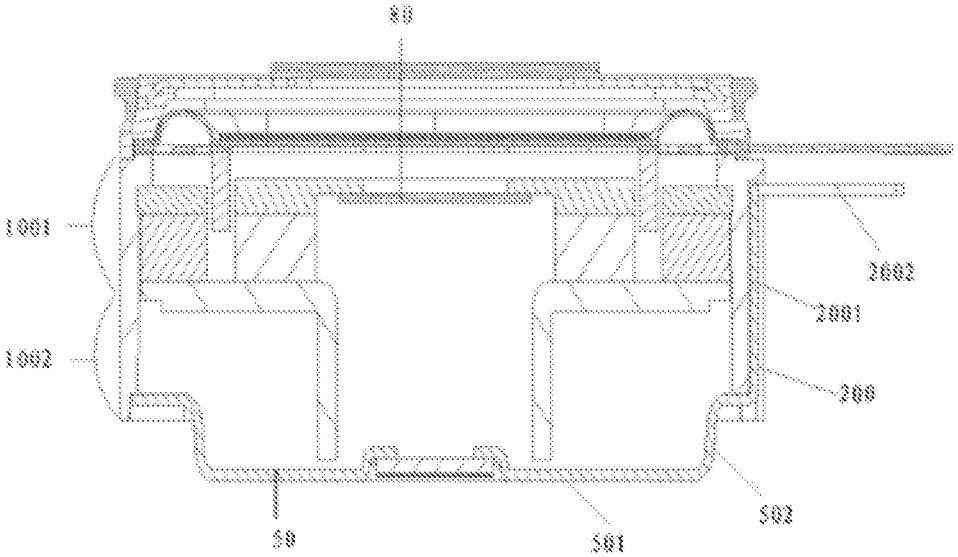
FIG. 9 is a schematic cross-sectional view of a sound generator provided by another embodiment of the present invention.
Figure 10:
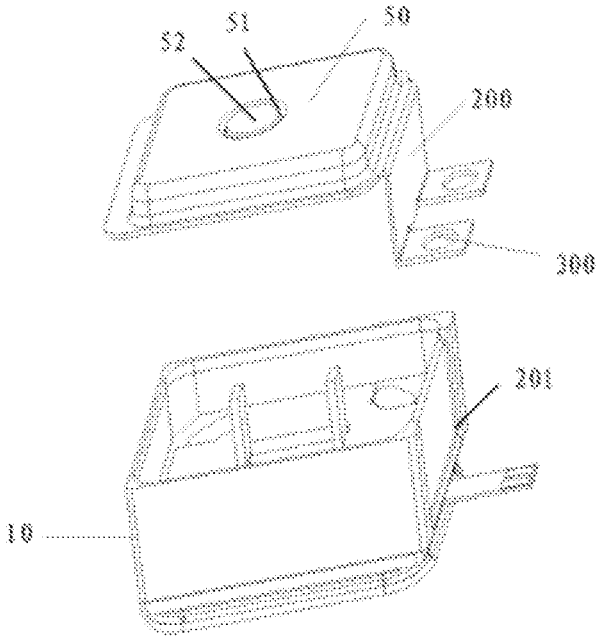
FIG. 10 is an exploded schematic view of the sound generator when the lower cover plate and the metal sheet are integrated in an embodiment of the present invention.

Method Two: as shown in FIGS. 9 and 10, the lower cover plate 50 is made of a metal, and the metal sheet 200 is integrally arranged with the lower cover plate 50. The metal sheet 200 is formed by bending and extending the edge of the lower cover 50 upward. The metal sheet 200 is fixed on the side wall of the shell 10.

In the Method Two, the metal sheet 200 can be combined with the side wall of the shell 10 through a glue body, or a groove 201 is provided on the side wall of the shell 10 at a position corresponding to the metal sheet 200 (as shown in FIG. 10), and the metal sheet 200 is embedded in the groove 201 and fixed to the bottom of the groove 201. The integrally formed lower cover plate 50 and the metal sheet 200 not only realize the sealing of the rear cavity 60, but also realize shielding of the magnetic leakage.

Figure 3:
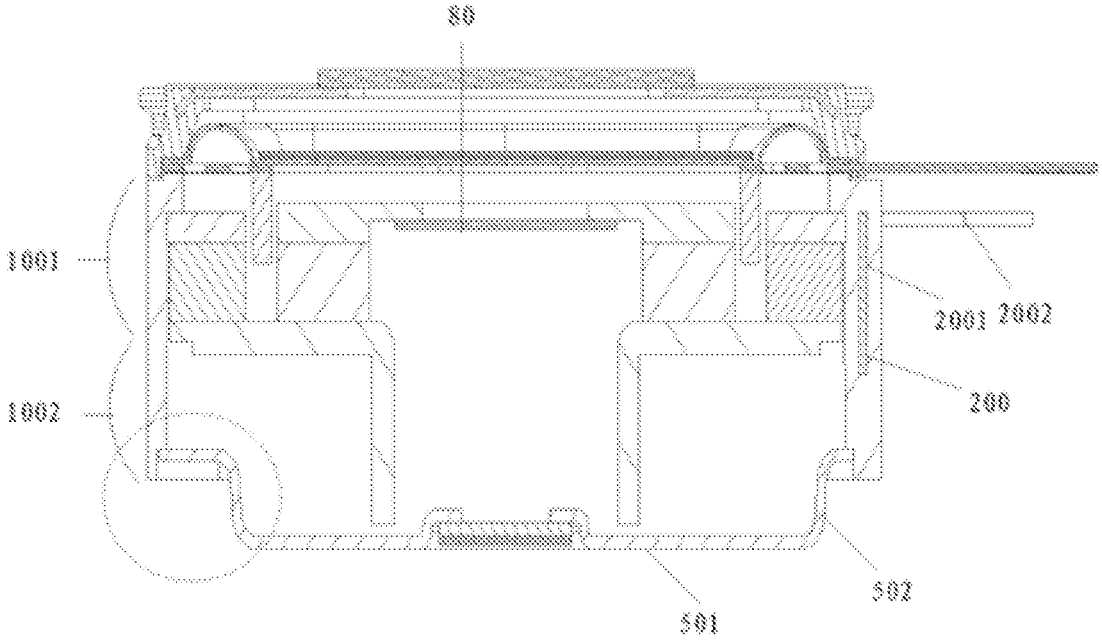
FIG. 3 is an another schematic cross-sectional view of a sound generator provided by an embodiment of the invention.
Figure 4:
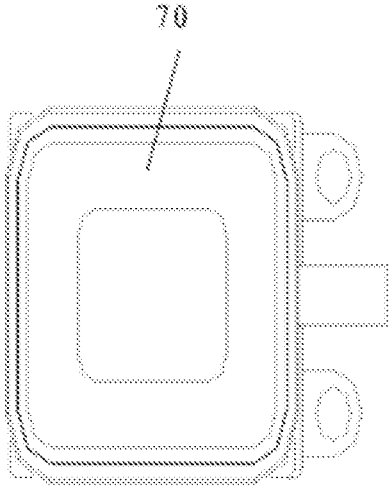
FIG. 4 is a schematic view of a top surface angle of a sound generator provided by an embodiment of the invention.
Figure 8:
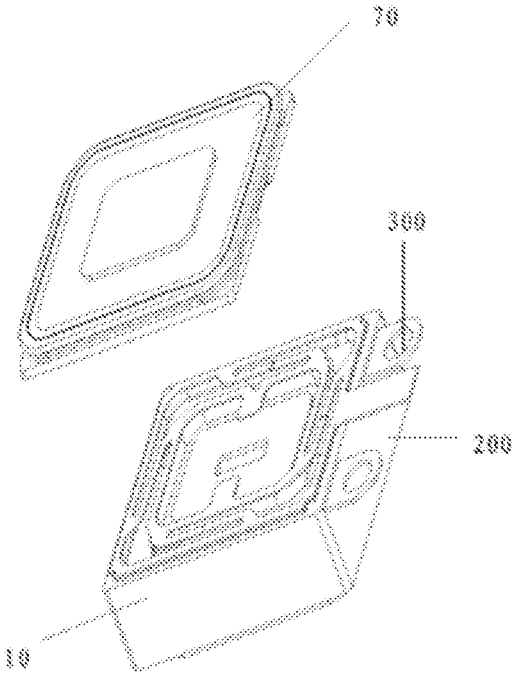
FIG. 8 is an exploded schematic view of the sound generator when the metal sheet is an individual component provided by an embodiment of the present invention.

Further, as shown in FIGS. 3 and 9, the metal sheet 200 includes a main body portion 2001 fixed on the side wall of the shell 10, and at least one fixing portion 2002 bent and extended outward from the end of the main body portion 2001. A positioning hole 300 is provided on the fixing portion 2002 (as shown in FIGS. 8 and 10). The positioning hole 300 on the fixing portion 2002 not only can realize the positioning of the speaker module in the electronic device, but also can fix the speaker module and the electronic device through the positioning hole 300. The positioning hole 300 includes but is not limited to a screw hole, and the speaker module is fixed to the electronic device by screws. As shown in FIG. 4, there are two fixing portions 2002.

Figure 2:
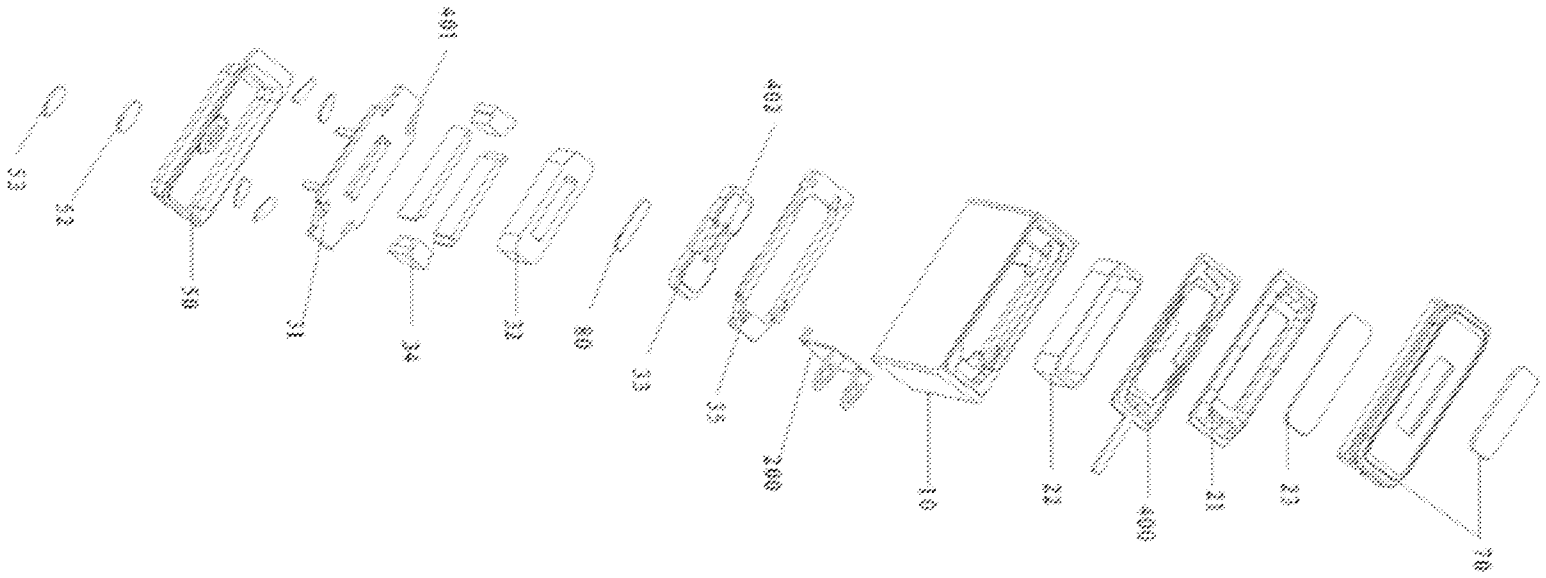
FIG. 2 is an exploded schematic view of a sound generator provided by an embodiment of the invention.

In an achievable solution, as shown in FIG. 2, the magnetic conductive yoke 31 is rectangular, and a corner of the magnetic conductive yoke 31 is provided with a first rear sound hole 401 in communication with the magnetic gap and the rear cavity 60; and the rear sound hole 40 comprises the first rear sound hole 401. More specifically, as shown in FIG. 2, each of the four corners of the magnetic conductive yoke 31 is provided with a notch; a corner of the magnetic conductive yoke 31 and the position close to the notch edge is provided with a first rear sound hole 401 communicating with the magnetic gap and the rear cavity 60.

In order to further increase the volume of the rear cavity to improve the acoustic characteristics of the sound generator, another embodiment of the present invention proposes to provide a through hole in the magnetic circuit system, and use the through hole as a part of the rear cavity to increase the volume of the rear cavity. Specifically, as shown in FIG. 1, the central magnetic circuit portion 301 comprises a central magnet 32 and a central magnetic conductive plate 33 provided on a top surface of the central magnet 32; at the central magnetic circuit portion 301, the magnetic circuit system 30 is provided with a through hole that sequentially penetrates the magnetic conductive yoke 31 and the central magnet 32 as a part of the rear cavity 60, and a second rear sound hole 402 in communication with the through hole is provided on the central magnetic conductive plate 33; the rear sound hole 40 comprises the second rear sound hole 402.

As the four first rear acoustic holes 401 at the four corners of the magnetic conductive yoke 31 cannot achieve the best air circulation effect with the rear cavity 60, thus in this embodiment, a second rear sound hole 402 in communication with the through holes in the magnetic conductive yoke 31 and the central magnet 32 is provided on the central magnetic conductive plate 33 as a fifth rear sound hole. The four first rear sound holes 401 and the second rear sound hole 402 together constitute the rear sound hole 40 provided on the magnetic circuit system. The No. 5 rear sound hole not only can play the role of expanding the capacity of the rear cavity 60, but also can solve the problem of the degradation of the stability of the vibration system due to the increase of the acoustic resistance of the vibration caused by the small distance between the vibration system and the magnetic circuit of the miniaturized device.

Additional explanation to be made here is that the central area of the central magnet 32 contributes less to the BL of the sound generator (a parameter which measures the strength of the driving system in the sound generator) than the boundary area. Therefore, when the volume of the rear cavity 60 is limited, the center area of the central magnet 32 is hollowed-out to increase the volume of the rear cavity, which helps to improve the performance of the product.

Although influence of the hollowed-out area of the central magnet 32 on the BL value of the magnetic circuit system 30 is small, the influence is somewhat unneglectable. If the hollowed-out area of the central magnet 32 is too large, its influence on the BL value of the magnetic circuit system 30 cannot be ignored. If the hollowed-out area is too large, the BL value of the magnetic circuit system 30 will be smaller, and the performance of the product will be lower. Therefore, it is necessary to find a balance range such that the increase of the volume of the rear cavity 60 since the center magnet 32 is hollowed-out improves the product performance more than the reduction in the BL value of the magnetic circuit system reduces the product performance, thereby optimizing the product performance. Through simulation, it is known that when the hollowed-out volume of the center magnet 32 accounts for less than 35% of the original volume of the center magnet, the product performance is improved. When the hollowed-out volume of the center magnet 32 exceeds this range, the BL value of the magnetic circuit system 30 sharply decreases. At this time, the increase in the space of the rear cavity 60 has a lower performance improvement effect than the product performance reduction effect caused by the decrease of the BL value of the magnetic circuit system, and the overall performance is the reduction of product performance. Therefore, in the above technical solution provided by the invention, the opening volume of the center magnet should satisfy: the ratio of the opening volume of the center magnet 32 to the volume of the center magnet 32 before opening is less than or equal to 35%, and can be further controlled to 5%-30%.

In an achievable solution, the through hole is composed of the central hole of the magnetic conductive yoke 31 and the central hole of the central magnet 32, and the support foot 310 is arranged at a peripheral position of the central hole of the magnetic conductive yoke 31. The support foot 310 is arranged at the peripheral position of the central hole of the magnetic conductive yoke 31 such that it can effectively prevent the lower cover plate 50 from being forced to produce a large amount of deformation.

The support foot 310 may be an individual component and fixed on the magnetic conductive yoke 31 by welding or gluing; or, the support foot 310 and the magnetic conductive yoke 31 may be an integral structure, specifically, as shown in FIG. 1, the support foot 310 being formed by stamping a material located at the central hole of the magnetic conductive yoke 31 before the magnetic conductive yoke 31 is holed. The structure of the support foot formed by stamping is firm with a simple manufacturing process.

Further, in the above sound generator, a gap is between the support foot 310 and the lower cover plate 50. Since the elastic deformation of the lower cover plate under relatively small pressure will recover itself after the pressure is removed, there is a gap between the support foot 310 and the lower cover plate 50, which will not affect the function of preventing excessive deformation of the support foot 310, and can also reduce the amount of material used for the support foot 310.

In an achievable solution, the lower cover plate 50 can be made of a metal, and the metal material can be made thinner and occupy a smaller space.

Further, as shown in FIGS. 1 and 3, the shell 10 comprises a straight cylinder-shaped shell body portion with openings at two ends, and the shell body portion accommodates and fixes the vibration system 20 and the magnetic circuit system 30; the vibration system 20 comprises a diaphragm 21 and a voice coil 22 fixed below the diaphragm 21, the diaphragm 21 being fixed on an end surface of a first end opening of the shell body portion; the voice coil 22 is suspended in the magnetic gap; the shell body portion comprises a first portion 1001 corresponding to the vibration system 20 and the magnetic circuit system 30, and a second portion 1002 integrally extending downward from the first portion 1001 beyond a bottom surface of the magnetic circuit system 30; the lower cover plate 50 is mounted at a second end opening of the shell body portion; and a rear cavity is formed between the second portion of the shell body portion 1002, the bottom surface of the magnetic circuit system 30 and the lower cover plate 50.

In order to reduce the volume of the sound generator and maximize the magnetic circuit system, as shown in FIG. 1, an outer side of the magnetic circuit system 30 is disposed in close contact with an inner wall of the shell body portion. Specifically, an outer side of the side magnetic circuit portion 302 is disposed in close contact with the inner wall of the shell body portion. Further, the peripheral side of the magnetic conductive yoke 31 is also disposed in close contact with the inner wall of the shell body portion.

Compared with the prior art, the technical solution provided by the embodiments of the invention directly forms a sufficiently large rear cavity space from the lower end portion of the shell of the sound generator. There is no need to additionally configure the box structure forming the rear cavity, thus it will not increase the occupied space in the horizontal direction, and the peripheral area of the shell of the sound generator determines the size of the space occupied by the entire sound generating device in the electronic product, which helps to achieve miniaturization of the product, and on the basis of miniaturization, it can take into account both the volume of the magnetic circuit system and the volume of the rear cavity, thereby ensuring acoustic performance. Secondly, a rear cavity is arranged directly below the vibration system and the magnetic circuit system, and the rear cavity has a regular shape and is close to the rear acoustic hole. Compared with the prior art, the same large rear cavity volume can achieve a better acoustic effect. In addition, the technical solution provided by the embodiments of the invention is only to lengthen the design of the shell of the sound generator, the structure is simple, and there is no need to perform fabrication between the sound generator and the box or the box structure, which can simplify the manufacturing process and mounting process and increase the production efficiency.

Figure 5:
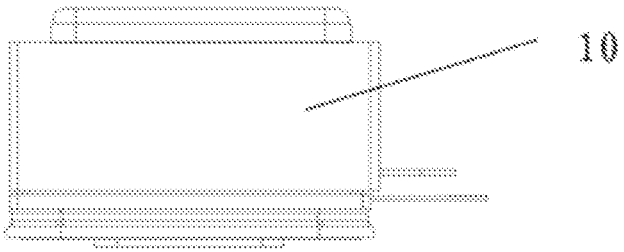
FIG. 5 is a schematic view of a side surface angle of a sound generator provided by an embodiment of the invention.
Figure 6:
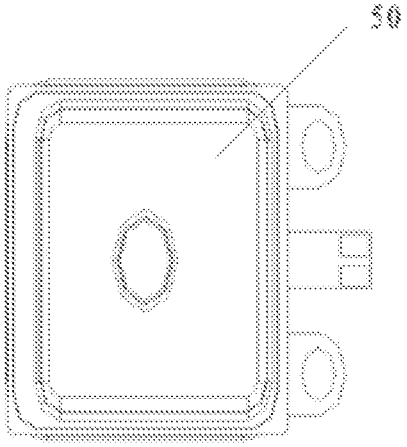
FIG. 6 is a schematic view of a bottom surface angle of a sound generator provided by an embodiment of the invention.

FIGS. 4, 5 and 6 show outer contour schematic diagrams of an implementation form of a sound generator provided by an embodiment of the invention. As shown in FIGS. 4, 5 and 6, the shell 10 of the sound generator provided in this embodiment may be a rectangular structure. For example, a sound generator adopting the technical solution provided by an embodiment of the invention can be prepared to have a plane size of (6-30) mm* (8-30) mm, and then by providing a rear sound hole with a capacity expansion effect on the magnetic circuit system, the purpose of reducing the height dimension of the sound generator is achieved.

Further, the lower cover plate is of a flat plate shape (not shown). Or, as shown in FIG. 3, the lower cover plate 50 is of a bowl-shaped structure provided with a bottom wall 501 and a side wall 502.

In the embodiment in which the lower cover plate 50 is of a bowl-shaped structure, the lower cover plate 50 being of the bowl-shaped structure has higher strength and occupies a small space, and the existence of the side wall 502 forms a part of the rear cavity space. Therefore, the height of the shell 10 can be reduced to avoid the problem that the wall thickness of an excessively high plastic shell needs to be increased to ensure the overall structural strength, which will increase the space occupied, and is more conducive to product miniaturization.

In the sound generator provided in this embodiment, when the lower cover plate 50 is made of a metal, the following two ways can be adopted to realize the connection of the lower cover plate and the second end opening of the shell body portion. Of course, the embodiments of the present invention are not limited to the following connection ways.

Figure 7:
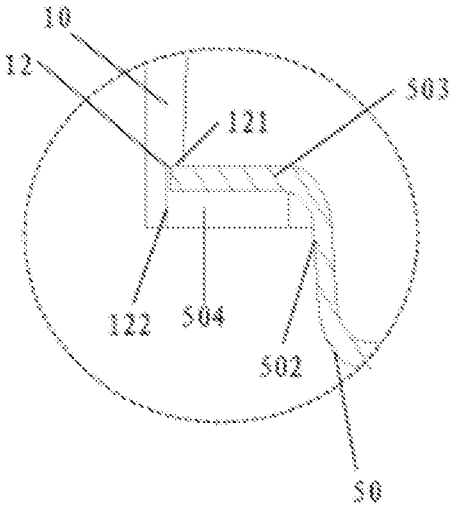
FIG. 7 is a partial enlarged schematic view of FIG. 3.

In the first way, as shown in FIG. 7, an inner side of the end surface of the second end opening of the shell body portion is provide with a recessed second stepped end surface 12, the second stepped end surface 12 is provided with a top surface 121 and a side surface 122 for mounting the lower cover plate 50; the lower cover plate 50 is of a flat plate shape (not shown), an edge of the lower cover plate 50 is provided with a recessed portion recessed toward the rear cavity 60, the recessed portion abuts on the top surface 121 of the second stepped end surface, a first glue holding groove is formed between the recessed portion and the side surface 122 of the second stepped end surface 12, and the first glue holding groove is coated with glue to fix the lower cover plate 50 on the shell body portion. Or, as shown in FIGS. 3 and 7, the lower cover plate 50 is of a bowl-shaped structure provided with a bottom wall 501 and a side wall 502, an end of the side wall 502 of the lower cover plate 50 is bent outward to provide a mounting edge 503, the mounting edge 503 abuts on the top surface 121 of the second stepped end surface 12, a second glue holding groove 504 is formed between the mounting edge 503 and the side surface 122 of the second stepped end surface 12, and the second glue holding groove 504 is coated with glue to fix the lower cover plate 50 on the shell body portion.

In the second way, a plastic edge (not shown) is injection-molded on a periphery of the lower cover plate 50, and the plastic edge is ultrasonically welded to the second end opening of the shell body portion.

Further, as shown in FIGS. 1 and 2, the rear sound hole 40 is provided with a breathable spacer 80, and the rear cavity 60 is filled with sound absorbing material. The sound absorbing material may be zeolite material, activated carbon material, or other materials with capacity expansion effect, which is not limited in this patent, wherein, the breathable spacer 80 is a mesh cloth that allows air to pass and does not allow sound absorbing material to pass, and is used to isolate the sound absorbing material and prevent it from entering the magnetic circuit system. Filling the rear cavity with sound absorbing material can further increase the volume of the rear cavity, which helps to improve the performance of the sound generator. The way of providing the breathable spacer 80 directly on the rear sound hole 40 can use all the space of the rear cavity to fill the sound absorbing material, thus increasing the filling amount of the sound absorbing material, and achieving a better capacity expansion effect. In the case that the through hole disposed in the magnetic conductive yoke 31 and the central magnet 32 increases the rear cavity and is filled with sound absorbing material for the capacity expansion, the second rear sound hole 402 is located at the center of the magnetic circuit system, and the contact rate between the sound absorbing material at the position of the through hole and the air can be increased to achieve an optimal capacity expansion performance.

More specifically, the sound generator provided by the embodiment of the present invention may further include: as shown in FIG. 2, a centering support piece 400 arranged between the diaphragm 21 and the voice coil 22, and a reinforcement part 23 provided on the side of the diaphragm 21 away from the magnetic circuit system 30; the reinforcement part 23 is fixed to the diaphragm 21, as shown in FIG. 1.

Further, as shown in FIGS. 1, 2 and 8, the shell 10 further comprises an upper cover plate 70 arranged above the diaphragm 21, and the upper cover plate 70 can be ultrasonically welded to the first end of the main body of the shell.

Further, as shown in FIGS. 1 and 2, the lower cover plate 50 is provided with a filling hole 51 for filling the sound absorbing material, and a cover sheet 52 is encapsulated on the filling hole 51. The cover sheet 52 may be just a hard sheet that is not air-permeable, and only serves to seal the sound absorbing material. As an another embodiment, the cover sheet 52 may be provided with air-permeable micro-holes that allow air to pass and do not allow the sound absorbing material to pass; or, the cover sheet 52 is provided with a leak hole, and the leak hole is covered with a damping 53 (as shown in FIG. 2) that allows air to pass and does not allow the sound absorbing material to pass. The above-mentioned specific embodiment makes the filling hole 51 serve as a leakage hole of the rear cavity, and can be used to balance the air pressure inside and outside the sound generator. Further, the acoustic resistance can be adjusted by adjusting the size of the air-permeable micro-holes or the mesh size of the damping net.

Although some specific embodiments of the invention have been demonstrated in detail by way of examples, it should be understood by a person skilled in the art that the above examples are only intended to be illustrative rather than to limit the scope of the invention. It should be understood by a person skilled in the art that the above embodiments can be amended without departing from the scope and spirit of the present invention. The scope of the present invention is defined by the attached claims.

The invention claimed is:

1. A sound generator, comprising a shell, a vibration system and a magnetic circuit system; wherein, the shell sequentially accommodates and fixes the vibration system and the magnetic circuit system from a top to a bottom;

the magnetic circuit system comprises a magnetic conductive yoke, a central magnetic circuit portion and a side magnetic circuit portion mounted on an upper surface of the magnetic conductive yoke; wherein a magnetic gap is formed between the central magnetic circuit portion and the side magnetic circuit portion; and at least one of the central magnetic circuit portion and the side magnetic circuit portion is provided with a permanent magnet;

the magnetic circuit system is provided with a rear sound hole;

a rear cavity in communication with the rear sound hole is provided directly below the magnetic circuit system;

the shell further comprises a lower cover plate located at a bottom of the sound generator, wherein the lower cover plate is configured to close the rear cavity; and at least one support foot extending toward the lower cover plate is provided on the magnetic conductive yoke.

2. The sound generator according to claim 1, wherein, the magnetic conductive yoke is rectangular, and a corner of the magnetic conductive yoke is provided with a first rear sound hole in communication with the magnetic gap and the rear cavity;

the rear sound hole comprises the first rear sound hole.

3. The sound generator according to claim 1, wherein, the central magnetic circuit portion comprises a central magnet and a central magnetic conductive plate provided on a top surface of the central magnet; at the central magnetic circuit portion, the magnetic circuit system is provided with a through hole that sequentially penetrates the magnetic conductive yoke and the central magnet as a part of the rear cavity, and a second rear sound hole in communication with the through hole is provided on the central magnetic conductive plate;

the rear sound hole comprises the second rear sound hole.

4. The sound generator according to claim 3, wherein, the through hole includes a central hole of the magnetic conductive yoke and a central hole of the central magnet, and the support foot is provided at a peripheral position of the central hole of the magnetic conductive yoke.

5. The sound generator according to claim 4, wherein, the support foot comprises a foot formed by stamping a material located at the central hole of the magnetic conductive yoke before the magnetic conductive yoke is holed.

6. The sound generator according to claim 1, wherein, there is a gap between the support foot and the lower cover plate.

7. The sound generator according to claim 1, wherein, the lower cover plate is made of a metal.

8. The sound generator according to claim 1, wherein, the shell comprises a straight cylinder-shaped shell body portion with openings at two ends, and the shell body portion accommodates and fixes the vibration system and the magnetic circuit system;

the vibration system comprises a diaphragm and a voice coil fixed below the diaphragm, the diaphragm being fixed on an end surface of a first end opening of the shell body portion; the voice coil is suspended in the magnetic gap;

the shell body portion comprises a first portion corresponding to the vibration system and the magnetic circuit system, and a second portion integrally extending downward from the first portion beyond a bottom surface of the magnetic circuit system;

the lower cover plate is mounted at a second end opening of the shell body portion; and a rear cavity is formed between the second portion of the shell body portion, the bottom surface of the magnetic circuit system and the lower cover plate.

9. The sound generator according to claim 8, wherein, an outer side of the magnetic circuit system is disposed in close contact with an inner wall of the shell body portion.

10. The sound generator according to claim 8, wherein, the shell is of a rectangular structure.

11. The sound generator according to claim 8, wherein, the lower cover plate is selected from the group consisting of a flat plate shape and a bowl-shaped structure provided with a bottom wall and a side wall.

12. The sound generator according to claim 8, wherein, the lower cover plate is made of a metal;

an inner side of an end surface of the second end opening of the shell body portion is provided with a recessed second stepped end surface, the second stepped end surface is provided with a top surface and a side surface for mounting the lower cover plate;

the lower cover plate is of a flat plate shape, an edge of the lower cover plate is provided with a recessed portion recessed toward the rear cavity, the recessed portion abuts on the top surface of the second stepped end surface, a first glue holding groove is formed between the recessed portion and the side surface of the second stepped end surface, and the first glue holding groove is coated with glue to fix the lower cover plate on the shell body portion.

13. The sound generator according to claim 8, wherein, the lower cover plate is made of a metal;

an inner side of an end surface of the second end opening of the shell body portion is provided with a recessed second stepped end surface, the second stepped end surface is provided with a top surface and a side surface for mounting the lower cover plate; and the lower cover plate is of a bowl-shaped structure provided with a bottom wall and a side wall, an end of the side wall of the lower cover plate is bent outward to provide a mounting edge, the mounting edge abuts on the top surface of the second stepped end surface, a second glue holding groove is formed between the mounting edge and the side surface of the second stepped end surface, and the second glue holding groove is coated with glue to fix the lower cover plate on the shell body portion.

14. The sound generator according to claim 8, wherein, the lower cover plate is made of a metal;

an inner side of an end surface of the second end opening of the shell body portion is provided with a recessed second stepped end surface, the second stepped end surface is provided with a top surface and a side surface for mounting the lower cover plate; and a plastic edge is injection-molded on a periphery of the lower cover plate, and the plastic edge is ultrasonically welded to the second end opening of the shell body portion.

15. The sound generator according to claim 1, wherein, the rear sound hole is provided with a breathable spacer and the rear cavity is filled with a sound absorbing material.

* * * * *